US012747562B2

(12) United States Patent
Saitoh et al.

(10) Patent No.: US 12,747,562 B2
(45) Date of Patent: Sep. 29, 2026

(54) WORK MACHINE

(71) Applicant: HITACHI CONSTRUCTION MACHINERY CO., LTD., Tokyo (JP)

(72) Inventors: Teppei Saitoh, Tokyo (JP); Ryu Narikawa, Tokyo (JP); Tadashi Nishizawa, Tokyo (JP); Hideaki Itou, Tokyo (JP); Hidefumi Ishimoto, Tokyo (JP); Kei Satou, Tokyo (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 168 days.

(21) Appl. No.: 18/685,263

(22) PCT Filed: Oct. 31, 2022

(86) PCT No.: PCT/JP2022/040739
§ 371 (c)(1),
(2) Date: Feb. 21, 2024

(87) PCT Pub. No.: WO2023/080114
PCT Pub. Date: May 11, 2023

(65) Prior Publication Data

US 2024/0376693 A1 Nov. 14, 2024

(30) Foreign Application Priority Data

Nov. 5, 2021 (JP) ..... 2021-181027

(51) Int. Cl.
*E02F 9/26* (2006.01)
*E02F 9/20* (2006.01)
*E02F 9/24* (2006.01)

(52) U.S. Cl.
CPC ..... *E02F 9/26* (2013.01); *E02F 9/205* (2013.01); *E02F 9/24* (2013.01)

(58) Field of Classification Search
CPC ..... E02F 9/26; E02F 9/205; E02F 9/24; E02F 3/435; E02F 9/2083; E02F 9/2087; E02F 9/261; E02F 9/262
See application file for complete search history.

(56) References Cited

U.S. PATENT DOCUMENTS

2018/0340316 A1* 11/2018 Izumikawa ..... E02F 3/435
2020/0024831 A1* 1/2020 Okada ..... E02F 9/2285
(Continued)

FOREIGN PATENT DOCUMENTS

JP 2009-208509 A 9/2009
JP 2020-159142 A 10/2020
WO 2020/166241 A1 8/2020

OTHER PUBLICATIONS

Extended European Search Report received in corresponding European Application No. 22889934.0 dated Jun. 11, 2025.
(Continued)

*Primary Examiner* — Peter D Nolan
*Assistant Examiner* — Demetra R Smith-Stewart
(74) *Attorney, Agent, or Firm* — MATTINGLY & MAUR, PC

(57) ABSTRACT

In a work machine, when on a travel plane S of crawler belts, a straight line passing through a predicted travel point P1 a given distance from the crawler belts and having a maximum climbing angle is assumed to be a first line L1, and a line connecting an installation position of a distance sensor and the predicted travel point P1 is assumed to be a second line L2. The distance sensor measures a distance to a ground surface on the second straight line L2. A controller calculates a height H1 of a predicted travel region T based on a result of the distance sensor and a detection result of a turning angle sensor, and determines whether a height difference H3 between a height H1 of the predicted travel region T and a
(Continued)

height H2 of the travel plane S is equal to or greater than a threshold.

9 Claims, 8 Drawing Sheets

(56) References Cited

U.S. PATENT DOCUMENTS

| | | | | |
|---|---|---|---|---|
| 2020/0165799 | A1* | 5/2020 | Wu | E02F 9/2033 |
| 2020/0291614 | A1* | 9/2020 | Kiyota | B60R 1/23 |
| 2022/0112693 | A1 | 4/2022 | Doi et al. | |
| 2022/0260381 | A1* | 8/2022 | Madsen | G06T 17/05 |
| 2024/0376693 | A1* | 11/2024 | Saitoh | E02F 9/205 |

OTHER PUBLICATIONS

International Search Report of PCT/JP2022/040739 dated Nov. 29, 2022.

* cited by examiner

WORK MACHINE

TECHNICAL FIELD

The present invention relates to a work machine such as a hydraulic shovel.

BACKGROUND ART

Work machines such as hydraulic shovels working in mines, for example, perform excavating and loading works days and nights at sites with various height differences. In such environment, there is a problem in that due to dust often floating in the air and the dark work site at night, the visibility from the driver's seat of the hydraulic shovel is poor. In addition, such a hydraulic shovel working in mines has a large vehicle body, which makes it uneasy to view, from the driver's seat, the surroundings of the traveling crawler belts of the footing. Therefore, if the hydraulic shovel travels without noticing a large step at the footing, the crawler belts fall into the step or the hydraulic shovel falls from the step, thereby making it impossible to maintain the stability of the vehicle body in some cases. If the vehicle body becomes unstable, the work is suspended, which lowers the productivity.

Thus, as a technique to maintain the stability of a vehicle body of a work machine, for example, a hydraulic shovel disclosed in Patent Literature 1 below has been considered. Specifically, the hydraulic shovel is provided, on its front device, with a distance measurement sensor that measures the distance to the ground surface vertically below to obtain a height difference by subtracting the height of the point of the position vertically below the distance measurement sensor from the height of the ground surface where a lower traveling body contacts, and restricts the travelling of the hydraulic shovel when the obtained height difference is greater than a threshold. In this manner, the stability of the vehicle body is maintained.

CITATION LIST

Patent Literature

Patent Literature 1: JP 2020-159142 A

SUMMARY OF INVENTION

Technical Problem

However, in the hydraulic shovel disclosed in the aforementioned Patent Literature 1, the distance measurement sensor is rotatably installed on the front device so as to be directed vertically downward irrespective of the posture of the front device, and thus, oscillates in the rotating direction of the distance measurement sensor during the operation of the front device. Such rotary swing generates noise, which makes it difficult to accurately measure the distance. To accurately measure the distance, for example, performing the measurement when the operation of the front device is decelerated or suspended may be conceived, but deceleration or suspension of the front device would affect the productivity of the work machine. Therefore, the hydraulic shovel described in Patent Literature 1 still needs to be improved.

The present invention has been made to solve such a technical problem and provides a work machine capable of maintaining the stability of a vehicle body and suppressing lowering of the productivity due to an unstable vehicle body.

Solution to Problem

A work machine according to the present invention is a work machine provided with a lower traveling body having crawler belts and an upper turning body provided in the lower traveling body so as to freely turn and including: at least one distance measurement sensor installed on the upper turning body; a turning angle sensor that detects a relative turning angle between the upper turning body and the lower traveling body; a notification device that notifies an operator of the work machine of information; and a control device that controls the lower traveling body and the notification device, in which when on a travel plane of the crawler belts, a straight line passing a predicted travel point distanced by a given distance from the crawler belts and having an angle corresponding to a maximum climbing angle of the work machine relative to the travel plane of the crawler belts is assumed to be a first straight line, and a straight line connecting an installation position of the distance measurement sensor and the predicted travel point is assumed to be a second straight line, the distance measurement sensor is positioned above the first straight line and measures a distance from the installation position to a ground surface on the second straight line, and when a region on the ground surface measured by the distance measurement sensor is assumed to be a predicted travel region, the control device calculates a height of the predicted travel region based on a measurement result of the distance measurement sensor and a detection result of the turning angle sensor, and determines whether a height difference between the height of the predicted travel region calculated and a height of the travel plane of the crawler belts is equal to or greater than a preset threshold, and actuates the notification device when it is determined that the height difference is equal to or greater than the threshold.

In the work machine according to the present invention, when on the travel plane of the crawler belts, the straight line passing the predicted travel point distanced by a given distance from the crawler belts and having an angle corresponding to the maximum climbing angle of the work machine relative to the travel plane of the crawler belts is assumed to be the first straight line, and the straight line connecting the installation position of the distance measurement sensor and the predicted travel point is assumed to be the second straight line, the distance measurement sensor is installed on the upper turning body so as to be positioned above the first straight line and measures the distance from the installation position to the ground surface on the second straight line. In this manner, the distance measurement sensor can measure the distance at an angle greater than the maximum climbing angle, so that a step with the height difference exceeding the maximum climbing angle can be surely detected. Further, when it is determined that the height difference is equal to or greater than the threshold, the control device actuates the notification device so that the operator of the work machine can be notified of the information via the notification device. As a result, even when the visibility from the driver's seat is poor, the operator can notice the presence of the step in the predicted travel region. In this manner, it is possible to prevent the crawler belts from falling into the step or the work machine from falling from the step, and thus, the stability of the vehicle body of the work machine can be maintained so as to suppress lowering of the productivity due to the unstable vehicle body.

Advantageous Effects of Invention

According to the present invention, the stability of a vehicle body can be maintained and lowering of the productivity due to an unstable vehicle body can be suppressed.

DESCRIPTION OF EMBODIMENTS

Hereinafter, with reference to the drawings, an embodiment of a work machine according to the present invention will be described. In the description of the drawings, the same elements are assigned the same reference signs and the overlapping descriptions will be omitted. Further, an example of a hydraulic shovel as the work machine will be described below, but the present invention is not limited to the hydraulic shovel, and is also applied to work machines such as a crawler crane. Further, in the following description, up-down, left-right, and front-rear directions and positions are based on a normal use state of the hydraulic shovel, i.e., the state of a lower traveling body contacting the ground surface.

First Embodiment

Figure 1:
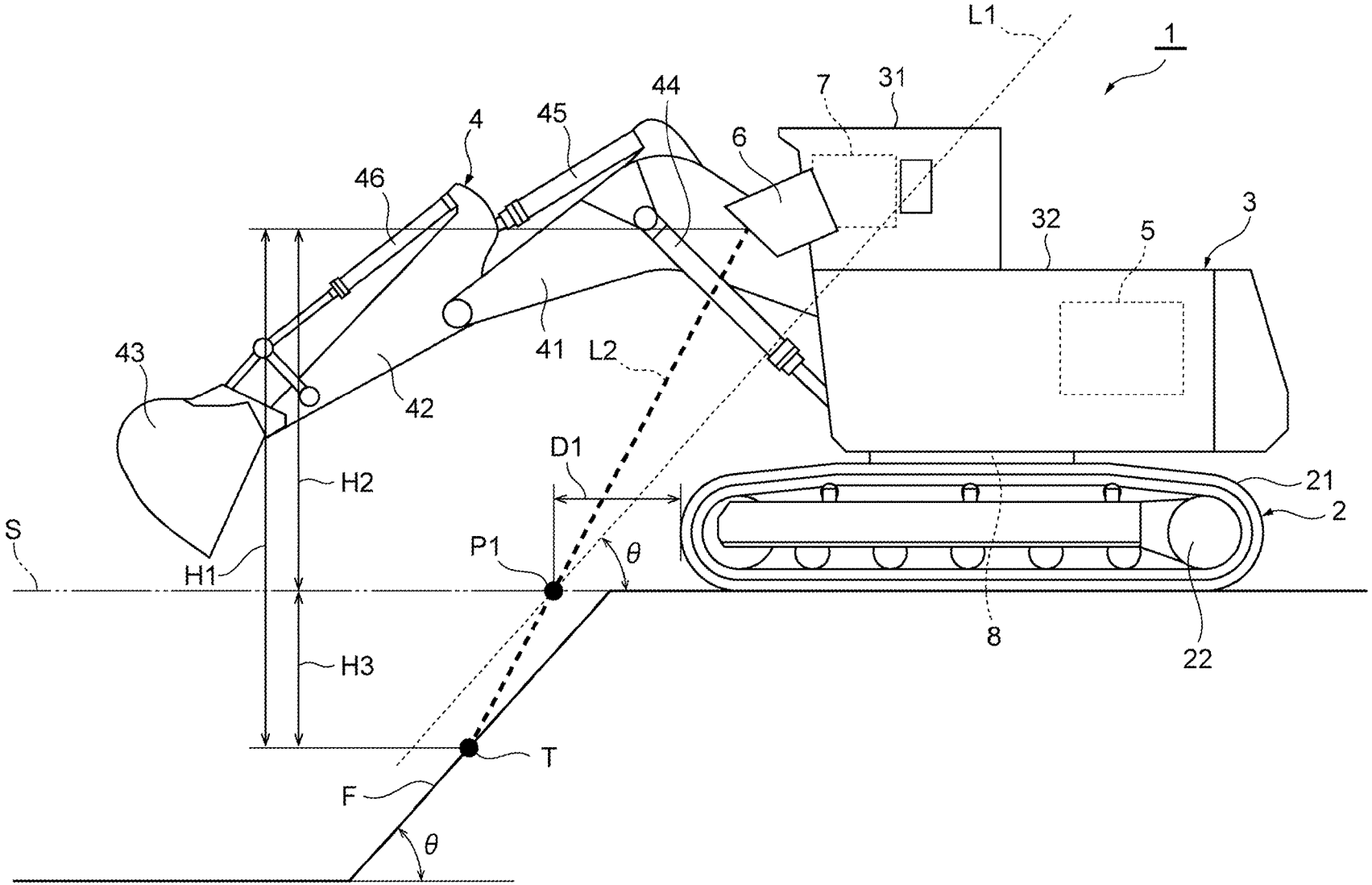
FIG. 1 is a side view showing a work machine according to a first embodiment.

FIG. 1 is a side view showing a work machine according to a first embodiment. The work machine 1 of the present embodiment is, for example, a hydraulic shovel and includes a lower traveling body 2 caused to travel by a power system, an upper turning body 3 installed so as to freely turn in the left-right direction relative to the lower traveling body 2, and a front device 4 installed on the upper turning body 3 and performing excavation work or the like. In the present embodiment, the lower traveling body 2 and the upper turning body 3 form a vehicle body of the work machine 1.

The lower traveling body 2 includes a pair of left and right crawler belts 21, a travel motor (not shown) that drives each of the pair of crawler belts 21, and a travel controller 22 that controls the travel motor and the like. The travel motor drives each of the left and right crawler belts 21 in accordance with a command from the travel controller 22. In this manner, the lower traveling body 2 can move forward or backward, turn to the left or right, or make a counter-rotation turn (also referred to as a turn in place). Further, the travel controller 22 is electrically connected to a control device 5 described later and controls driving of the travel motor or the like in accordance with a travel control command from the control device 5. Here, the counter-rotation turn means that the left and right crawler belts 21 are rotated in the reverse directions relative to each other to turn the lower traveling body 2 on the spot.

The upper turning body 3 includes a driver's cab 31 and a machine room 32. The driver's cab 31 is disposed in, for example, a left side part of the upper turning body 3 and is provided with a driver's seat where an operator performs operations of the work machine 1 while being seated. The machine room 32 is disposed, for example, on a rear side of the driver's cab 31. In the upper turning body 3, a turning motor (not shown) is disposed. When the turn motor is driven, the upper turning body 3 can turn relative to the lower traveling body 2.

The front device 4 is formed rotatably in the up-down direction relative to the upper turning body 3. The front device 4 includes a boom 41 coupled to the upper turning body 3, an arm 42 coupled to the boom 41, a bucket 43 coupled to the arm 42, a boom cylinder 44 that drives the boom 41, an arm cylinder 45 that drives the arm 42, and a bucket cylinder 46 that drives the bucket 43 via a bucket link or the like.

Further, the work machine 1 includes a turning angle sensor 8 that detects a relative turning angle between the upper turning body 3 and the lower traveling body 2, a notification device 7 that notifies an operator of the work machine 1 of information, a distance measurement sensor 6 installed on a front side of the upper turning body, and the control device 5 that performs controls of the work machine 1.

The turning angle sensor 8 is formed of, for example, a rotary encoder, and measures the turning angle of the upper turning body 3 relative to the lower traveling body 2 and outputs the measured result to the control device 5.

The notification device 7 is formed of, for example, a monitor and a speaker, and is disposed in the driver's cab 31. The notification device 7 is electrically connected to the control device 5 and notifies the operator of information via a character or a voice in accordance with a notification control command from the control device 5. In the present embodiment, the notification device 7 includes a display section 9 (described later) formed of a monitor.

The distance measurement sensor 6 is formed of, for example, 1D to 3D LIDAR, millimeter-wave radar, or a stereo camera. The distance measurement sensor 6 is installed on the upper turning body 3 (here, an outer side of a front glass of the driver's cab 31).

In the present embodiment, an installation position and a measurement position of the distance measurement sensor 6 are specified as follows. Specifically, as shown in FIG. 1, when on a travel plane S of the crawler belts 21 of the work machine 1, a straight line passing a predicted travel point P1 distanced by a given distance D1 from the crawler belts 21 and having the same angle as a maximum climbing angle θ of the work machine 1 relative to the travel plane S of the crawler belts 21 is assumed to be a first straight line L1, and a straight line connecting the installation position of the distance measurement sensor 6 and the predicted travel point P1 is assumed to be a second straight line L2, the distance measurement sensor 6 is installed on the upper turning body 3 so as to be positioned above the first straight line L1 and measures a distance from the installation position to the ground surface on the second straight line L2.

Here, the travel plane S is a virtual plane when the crawler belts 21 travel straight ahead. The predicted travel point P1 is a dotted region present on the travel plane S and is a region distanced by the given distance D1 from a distal end (here, front end) of the crawler belts 21. The position of the predicted travel point P1 (i.e., distance D1) is specified, for example, based on a value obtained by multiplying, by the maximum travel speed of the vehicle body, a response time after the control device 5 transmits a stop command to the travel controller 22 until the work machine 1 stops, i.e., a brake distance. Note that the position (i.e., distance D1) of the predicted travel point P1 may be set farther as compared to the brake distance.

The maximum climbing angle θ is the maximum angle of a slope F that the work machine 1 can climb and is set based on a specification value (climbing capability) of the work machine 1, but may be set so as to provide a safety margin to the specification value. That is, the maximum climbing angle θ may be set to be the same as the specification value or smaller than the specification value by putting emphasis on safety. The first straight line L1 is the straight line passing the predicted travel point P1 and having the same angle as the maximum climbing angle θ relative to the travel plane S. Further, the distance measurement sensor 6 is positioned above the first straight line L1 and is installed on the upper turning body 3. The distance measurement sensor 6 measures the distance from the installation position along the second straight line L2 to the ground surface, i.e., the distance to a location where the second straight line L2 and the slope F intersect with each other, and outputs the measured result to the control device 5.

In the present embodiment, a region on the ground surface measured by the distance measurement sensor 6 is assumed to be a predicted travel region T. The predicted travel region Tis a region having various shapes, and may be, for example, a plurality of dotted regions present around the work machine 1, a linear (for example, straight line or curved) region with continuous dots, or a ring-shaped (for example, circular ring-shaped or polygonal ring-shaped) region with continuous dots surrounding the work machine 1. The shape of the predicted travel region T will be described later.

The control device 5 is configured with, for example, a microcomputer combining a CPU (Central Processing Unit) that performs calculation, a ROM (Read Only Memory) as a secondary memory device that records programs for calculation, and a RAM (Random Access Memory) as a temporary memory device that stores the calculation progress or temporary control variables, and performs controls of the work machine 1 by executing the programs stored.

Figure 2:
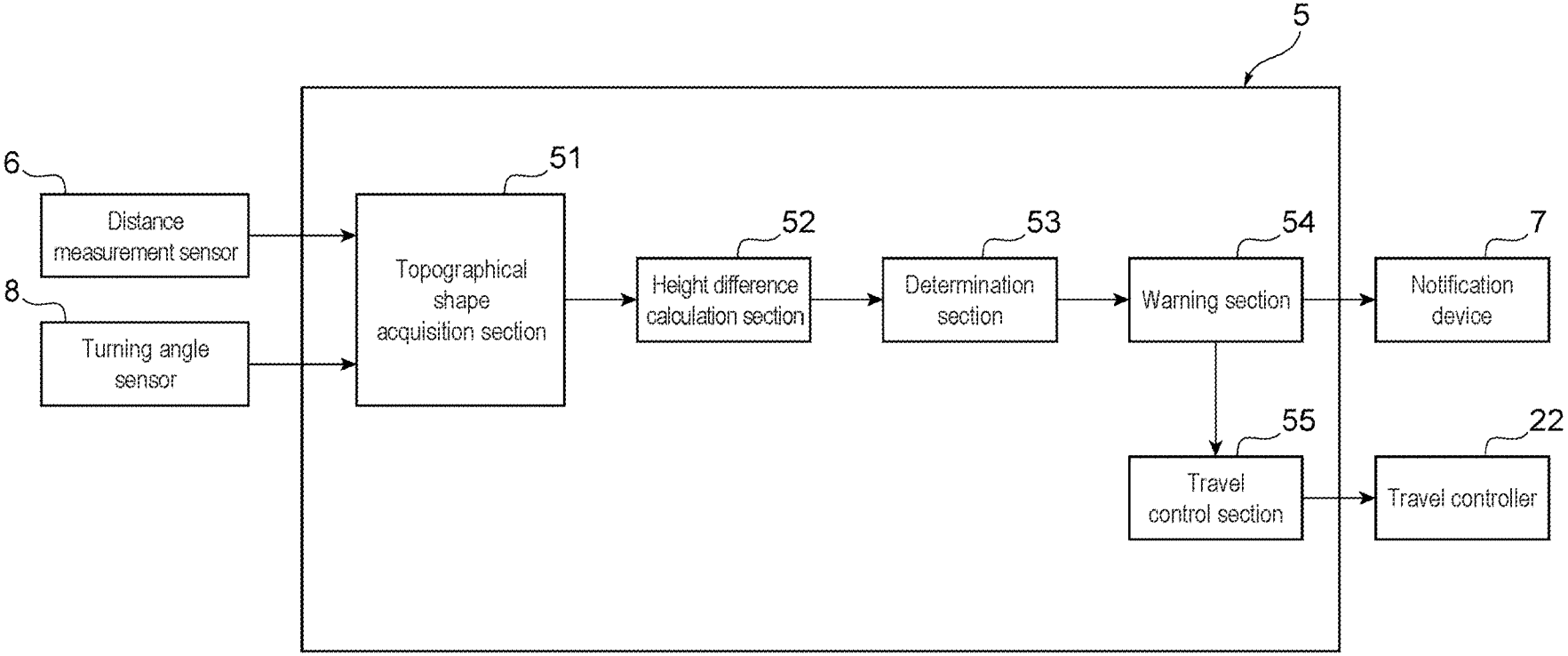
FIG. 2 is a functional block diagram showing a control device.

FIG. 2 is a functional block diagram showing the control device. As shown in FIG. 2, the control device 5 includes a topographical shape acquisition section 51, a height difference calculation section 52, a determination section 53, a warning section 54, and a travel control section 55. The topographical shape acquisition section 51 acquires the topographical shape of the predicted travel region T based on the distance measured by the distance measurement sensor 6 and the angle measured by the turning angle sensor 8.

The height difference calculation section 52 calculates a height H1 (see FIG. 1) of the predicted travel region T based on the topographical shape of the predicted travel region T acquired by the topographical shape acquisition section 51. Further, the height difference calculation section 52 calculates a difference (height difference H3 (see FIG. 1)) between a height H2 (see FIG. 1) of the travel plane S and the aforementioned calculated height H1 of the predicted travel region T. Note that the heights H1 and H2 are based on the installation position of the distance measurement sensor 6 and are each calculated based on the distance measured by the distance measurement sensor 6 and an inclination angle of the second straight line L2 relative to the travel plane S.

The determination section 53 determines whether the height difference calculated by the height difference calculation section 52 is equal to or greater than a preset threshold. The threshold is set, for example, based on a specification value of a height difference that the work machine 1 can climb over. Further, the determination section 53 sets a step detection flag based on the aforementioned determination result of whether the height difference is equal to or greater than the threshold. Specifically, when it is determined that the aforementioned height difference is equal to or greater than the threshold, the determination section 53 sets the "step detection flag" to "true" assuming that a step has been detected in the predicted travel region T. Meanwhile, when the aforementioned height difference is smaller than the threshold, the determination section 53 sets the "step detection flag" to "false." Note that the "step" referred to in the present embodiment indicates those having the difference (height difference H3) between the height H2 of the travel plane S and the height H1 of the predicted travel region T being equal to or greater than the threshold as described above.

When it is determined that the aforementioned height difference is equal to or greater than the threshold, the warning section 54 issues a command to actuate the notification device 7. That is, only when it is determined that the aforementioned height difference is equal to or greater than the threshold, the warning section 54 outputs the command to the notification device 7. When it is determined that the aforementioned height difference is equal to or greater than the threshold, the travel control section 55 outputs a command to the travel controller 22 to cause the lower traveling body 2 to immediately decelerate to stop traveling.

Figure 3:
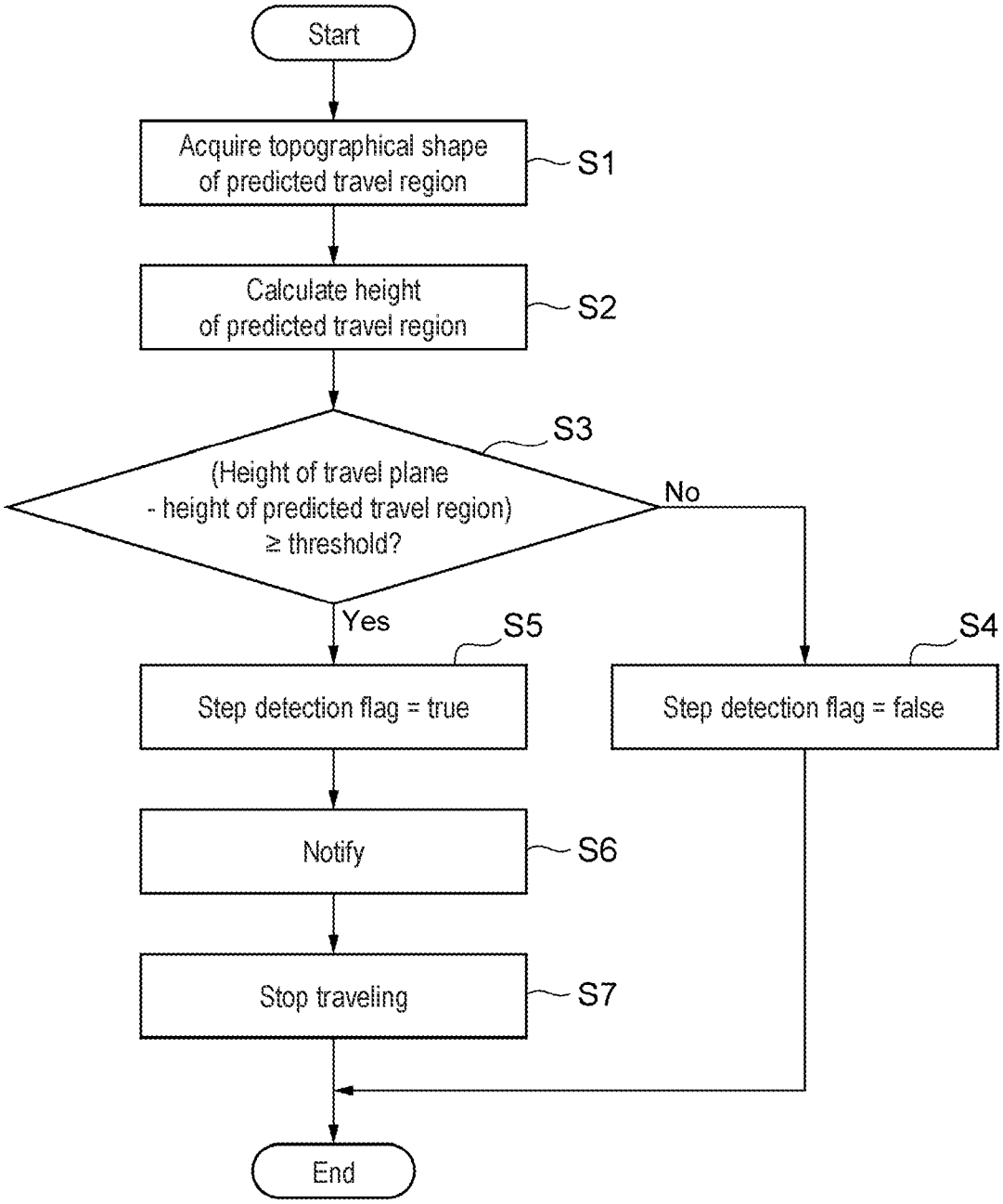
FIG. 3 is a flowchart showing control processing of the control device.

Hereinafter, control processing of the control device 5 will be described based on FIG. 3.

In step S1, the topographical shape acquisition section 51 acquires the topographical shape of the predicted travel region T based on the measurement result of the distance measurement sensor 6 and the detection result of the turning angle sensor 8.

In step S2 subsequent to step S1, the height difference calculation section 52 calculates the height H1 of the predicted travel region T based on the topographical shape of the predicted travel region T acquired in step S1. The height H1 of the predicted travel region T is, for example, a mean value of the height of the topographical shape of the predicted travel region T.

In step S3 subsequent to step S2, the height difference calculation section 52 calculates the difference (height difference H3) between the height H2 of the travel plane S measured in advance and the height H1 of the predicted travel region T calculated in step S2, and outputs the calculated height difference to the determination section 53. Then, the determination section 53 compares the height difference calculated by the height difference calculation section 52 and the preset threshold and determines whether the calculated height difference is equal to or greater than the threshold.

When it is determined that the calculated height difference is smaller than the threshold, the control processing proceeds to step S4. In step S4, the determination section 53 determines that the predicted travel region T has no step, and sets the "step detection flag" to "false." In this manner, the control processing ends.

Meanwhile, in step S3, when it is determined that the calculated height difference is equal to or greater than the threshold, the control processing proceeds to step S5. In step S5, the determination section 53 determines that the predicted travel region T has a step (in other words, a step is detected) and sets the "step detection flag" to "true."

In step S6 subsequent to step S5, the warning section 54 receives the step detection flag as "true" and outputs a command to actuate the notification device 7 to the notification device 7. In this case, in accordance with the command from the warning section 54, the notification device 7 notifies the operator of the step having been detected in the predicted travel region T, via character display, voice, or the like.

In step S7 subsequent to step S6, the travel control section 55 outputs, to the travel controller 22, a command to immediately decelerate to stop traveling of the lower traveling body 2. When step S7 ends, a series of control processing ends.

Note that in the aforementioned control processing, step S6 and step S7 may be simultaneously performed. Specifically, upon receipt of the step detection flag as "true," the warning section 54 outputs a command to the notification device 7 and simultaneously, the travel control section 55 outputs, to the travel controller 22, a command to decelerate to stop traveling of the lower traveling body 2. In this manner, upon receipt of the step detection flag as "true," the stop command is immediately output to the travel controller 22, thereby enabling to immediately stop the work machine 1 without a time lag, so that the safety of the work machine 1 can be improved. Note that in this case, the determination section 53 shown in FIG. 2 only needs to be directly connected to the travel control section 55 so that output can also be made to the travel control section 55.

Furthermore, in the aforementioned control processing, when it is determined that the height difference is equal to or greater than the threshold, the control device 5 may control the lower traveling body 2 so that the lower traveling body 2 travels in a direction in which the height difference is smaller than the threshold, in place of stopping traveling (step S7). For example, when a step is detected on the front side of the work machine 1 and no step is detected on the rear side of the work machine 1, the control device 5 allows the lower traveling body 2 to travel rearward and controls the lower traveling body 2 to travel rearward. This can prevent the work machine 1 from stopping traveling while maintaining the stability of the vehicle body.

In the work machine 1 of the present embodiment, when on the travel plane S of the crawler belts 21 of the work machine 1, the straight line passing the predicted travel point P1 distanced by the given distance D1 from the crawler belts 21 and having the same angle as the maximum climbing angle θ of the work machine 1 relative to the travel plane S of the crawler belts 21 is assumed to be the first straight line L1, and the straight line connecting the installation position of the distance measurement sensor 6 and the predicted travel point P1 is assumed to be the second straight line L2, the distance measurement sensor 6 is installed on the upper turning body 3 so as to be positioned above the first straight line L1 and measures the distance from the installation position to the ground surface on the second straight line L2. In this manner, the distance measurement sensor 6 can measure the distance at an angle greater than the maximum climbing angle θ, so that the step with the height difference exceeding the maximum climbing angle θ can be surely detected.

Further, when it is determined that the height difference is equal to or greater than the threshold, the control device 5 actuates the notification device 7 so that the operator of the work machine 1 can be notified of the information via the notification device 7. As a result, even when the visibility from the driver's seat is poor, the operator can notice the presence of the step in the predicted travel region T. Therefore, the operator stops the work machine 1 to be able to prevent the crawler belts 21 from falling into the step or the work machine 1 from falling from the step, and thus, the stability of the vehicle body of the work machine 1 can be maintained so as to suppress lowering of the productivity due to the unstable vehicle body.

Further, when it is determined that the height difference is equal to or greater than the threshold, the control device 5 controls the lower traveling body 2 to stop traveling. By doing so, even when the operator does not immediately stop the work machine 1 or continues traveling operation due to some reason while noticing that the step has been detected, via the notification device 7, the lower traveling body 2 is immediately decelerated to stop, so that the work machine 1 can be prevented from becoming an unstable state. Therefore, it is possible to maintain the stability of the vehicle body and to surely suppress lowering of the productivity due to the unstable vehicle body.

In addition, since the distance measurement sensor 6 is installed on the upper turning body 3, as compared to a case in which the distance measurement sensor 6 is installed on the front device 4 as conventionally adopted, the effect of the rotary swing on the measurement accuracy can be surely suppressed.

As described above, the predicted travel region T has various shapes. Hereinafter, four typical examples (T1 to T4) shown in FIG. 4 will be described.

Figure 4:
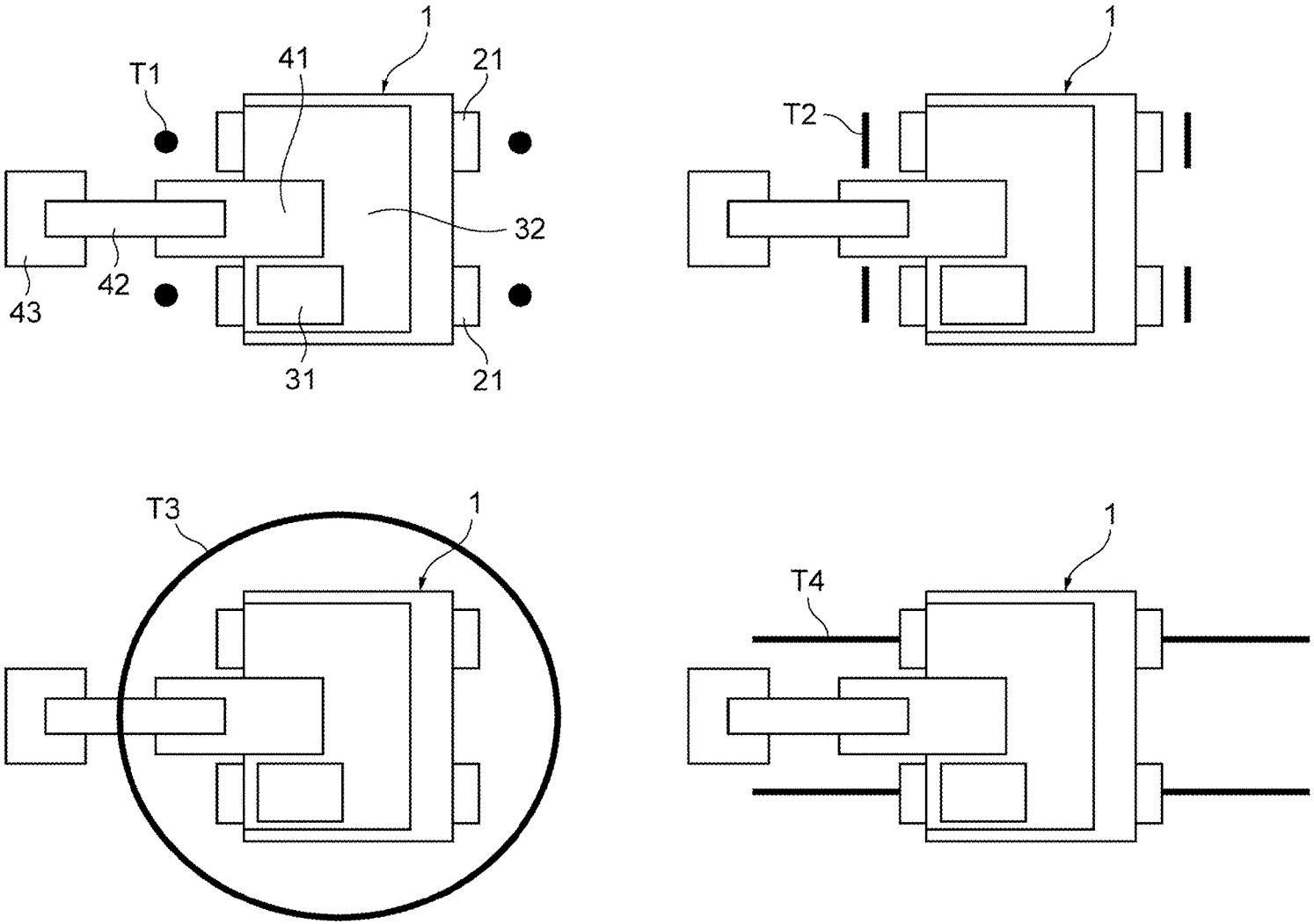
FIG. 4 is a plane view for explaining shapes of predicted travel regions.

First, the predicted travel region T1 shown in FIG. 4 is the most basic predicted travel region and is set as a plurality of dotted regions in the front-rear direction of the lower traveling body 2. Specifically, the predicted travel region T1 is composed of four dotted regions in total, each one of which is in the front and rear of each of the left and right crawler belts 21. Therefore, the topographical shape acquisition section 51 of the control device 5 acquires the topographical shape of each of the four dotted regions. This makes it possible to detect a step immediately ahead of the work machine 1 in the front-rear direction of the lower traveling body 2. Note that when the predicted travel region T1 in the rear of the crawler belts 21 is measured, it is only necessary to turn the upper turning body 3 rearward to perform the measurement using the distance measurement sensor 6.

Further, the predicted travel region T2 shown in FIG. 4 is set as a plurality of linear regions along the left-right direction of the lower traveling body 2. Specifically, the predicted travel region T2 is composed of four regions of straight lines in total, each one of which is in the front and rear of each of the left and right crawler belts 21. The length of each region may correspond to the width of the crawler belt 21, for example. In this manner, the topographical shape acquisition section 51 of the control device 5 acquires the topographical shape corresponding to the width of each crawler belt 21 in the front and rear of the left and right crawler belts 21. In this manner, since the mean value of the height of the topographical shape of the predicted travel region T2 can be used as the height of the topographical shape, the effect of the topographic bumps and dips or the like and the effect of the measuring noise of the distance measurement sensor 6 or the like can be suppressed, so that the height difference can be highly accurately calculated. Note that when the predicted travel region T2 in the rear of the crawler belts 21 is measured, it is only necessary to turn the upper turning body 3 rearward to perform the measurement using the distance measurement sensor 6.

The predicted travel region T3 shown in FIG. 4 is set as a ring-shaped region surrounding the lower traveling body 2. Specifically, the predicted travel region T3 is a circular ring-shaped or an elliptical ring-shaped region surrounding the lower traveling body 2. In this case, the topographical shape acquisition section 51 of the control device 5 acquires the topographical shape of the entire circumference of the lower traveling body 2. In this manner, a step on the lateral side of the lower traveling body 2 can also be detected. Therefore, for example, when the lower traveling body 2 makes a counter-rotation turn, the vehicle body can be prevented from becoming an unstable state due to the crawler belts 21 falling into the step on the lateral side of the lower traveling body 2. Note that when the predicted travel region T3 on the lateral side and in the rear of the crawler belts 21 is measured, it is only necessary to perform the measurement using the distance measurement sensor 6 while turning the upper turning body 3.

Further, the predicted travel region T4 shown in FIG. 4 is formed by a plurality of linear regions along the front-rear direction of the lower traveling body 2. Specifically, the predicted travel region T4 is composed of two regions of straight lines extending in the traveling direction of the left and right crawler belts 21. In this case, the topographical shape acquisition section 51 of the control device 5 acquires the topographical shape linearly relative to the front-rear direction of the lower traveling body 2. In this manner, a step farther than the predicted travel point P1 can be detected. Note that when the predicted travel region T4 in the rear of the crawler belts 21 is measured, it is only necessary to turn the upper turning body 3 rearward to perform the measurement using the distance measurement sensor 6.

Figure 5:
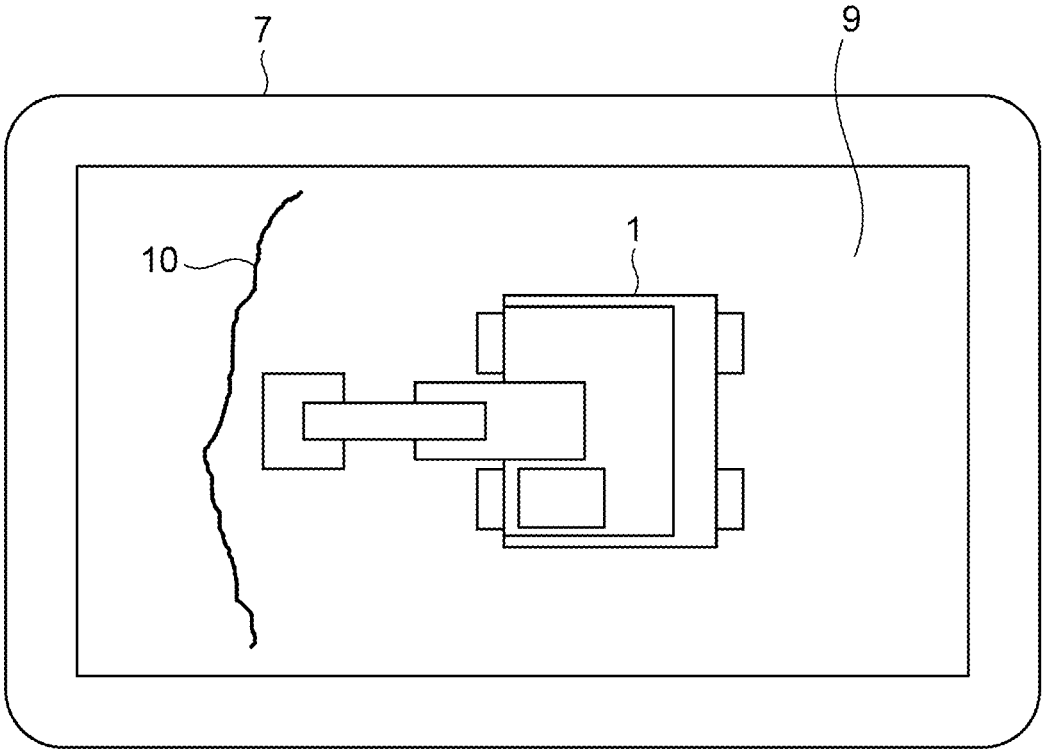
FIG. 5 is a view for explaining contents displayed on a notification device.

In addition, the predicted travel region may be a fan-shaped region of an aggregated plurality of regions radially extending forward about the lower traveling body 2. For example, a region farther than the predicted travel point P1 is measured by the distance measurement sensor 6 while turning the upper turning body 3 so as to draw a fan shape, so that a step in a given range ahead of the work machine 1 can be detected. In this manner, as shown in FIG. 5, for example, a ridge line 10 indicating the position of the step detected and the position of the work machine 1 are both displayed on the display section 9 of the notification device 7, so that the operator can notice the condition of a distant step at an early stage and the condition of the step is easily identified.

Note that the conditions under which the topographical shapes of the predicted travel regions T1 to T4 are acquired vary depending on whether the measurement range by the distance measurement sensor 6 is in a dotted, a linear, or a plane shape. For example, in the case of the predicted travel region T1, it is possible to acquire the topographical shape of the predicted travel region T1 in the measurement range by the distance measurement sensor 6 in any of dotted, linear, and plane shapes, but, in the case of the predicted travel region T4, the measurement range by the distance measurement sensor 6 needs to be in a linear or a plane shape.

Further, in the cases of the predicted travel regions T2 and T3, it is possible to acquire the topographical shapes of the predicted travel regions T2 and T3 in the measurement range by the distance measurement sensor 6 in any of dotted, linear, and plane shapes. For example, when the measurement range by the distance measurement sensor 6 is in a dotted shape, the topographical shapes of the predicted travel regions T2 and T3 can be acquired such that the distance is continuously measured by the distance measurement sensor 6 (in other words, the distance is measured so as to form continuous dots) while turning the upper turning body 3 and is combined with the turning angle measured by the turning angle sensor 8.

Second Embodiment

Hereinafter, a second embodiment of the work machine 1 will be described based on FIG. 6. The work machine 1 of the second embodiment differs from the aforementioned first embodiment in that the second embodiment is applied to remote operation. Here, only the contents that differ from the aforementioned first embodiment because of the difference will be described.

Figure 6:
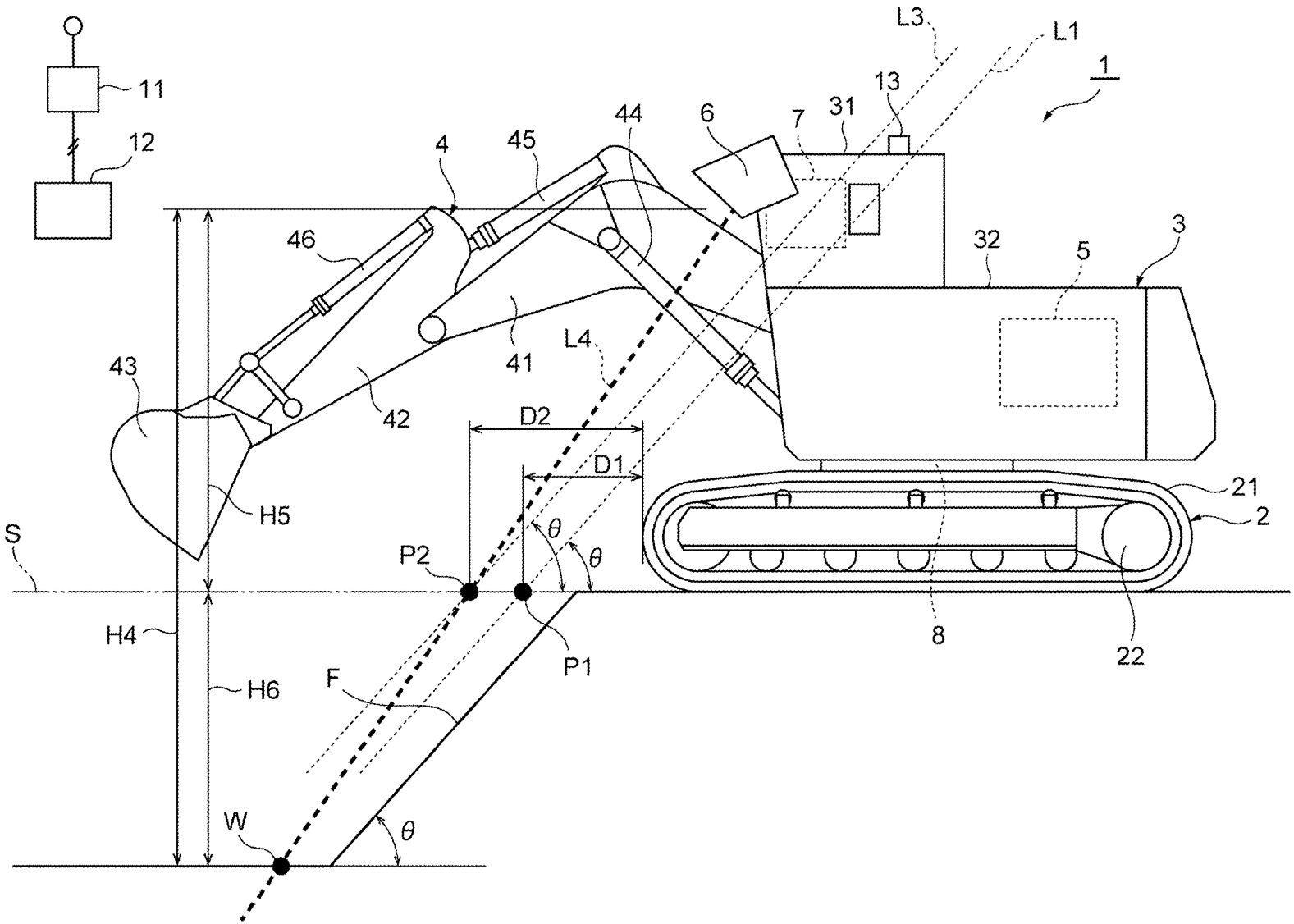
FIG. 6 is a side view showing a work machine according to a second embodiment.

As shown in FIG. 6, the work machine 1 of the second embodiment further includes a remote operation device 11 disposed at a remote location from the work machine 1 and configured to be capable of transmitting an operation command to the control device 5, a wireless transmitter 12 that transmits the operation command from the remote operation device 11, and a wireless receiver 13 disposed in the upper turning body 3 and receiving the command transmitted from the wireless transmitter 12. The wireless receiver 13 outputs the received command to the control device 5.

In the second embodiment, the distance measurement sensor 6 is installed on the upper turning body 3 (here, the outer side of the front glass of the driver's cab 31), but the installation position and the measurement position are specified as follows. That is, when on the travel plane S of the crawler belts 21, a straight line passing a remote operation predicted travel point P2 that is farther than the predicted travel point P1 relative to the work machine 1 and having an angle that is the same as or corresponding to the maximum climbing angle θ relative to the travel plane S of the crawler belts 21 is assumed to be a third straight line L3, and a straight line connecting the installation position of the distance measurement sensor 6 and the remote operation predicted travel point P2 is assumed to be a fourth straight line L4, the distance measurement sensor 6 is installed on the upper turning body 3 so as to be positioned further above the third straight line L3 and measures the distance from the installation position to the ground surface on the fourth straight line L4.

Here, the remote operation predicted travel point P2 is a point present on the travel plane S and distanced by a given distance D2 (D2>D1) from a distal end (here, front end) of the crawler belts 21. The position (i.e., distance D2) of the remote operation predicted travel point P2 is specified, for example, based on a value obtained by multiplying, by the maximum travel speed of the vehicle body, a value obtained by adding, to a response time after the control device 5 outputs a stop command to the travel controller 22 until the work machine 1 stops, a time of an operation command from the remote operation device 11 reaching the control device 5 via the wireless transmitter 12 and the wireless receiver 13, i.e., a brake distance by the remote operation. Note that the position (i.e., distance D2) of the remote operation predicted travel point P2 may be set farther as compared to the brake distance by the remote operation.

In the present embodiment, a region on the ground surface measured by the distance measurement sensor 6 is set to be a remote operation predicted travel region W. The remote operation predicted travel region W has various shapes as with the predicted travel region T of the aforementioned first embodiment and has the shapes shown in FIG. 4, for example.

Further, in the control device 5 of the present embodiment, the topographical shape acquisition section 51 acquires the topographical shape of the remote operation predicted travel region W based on the measurement result of the distance measurement sensor 6 and the detection result of the turning angle sensor 8. The height difference calculation section 52 calculates a height H4 (see FIG. 6) of the remote operation predicted travel region W based on the topographical shape of the remote operation predicted travel region W acquired by the topographical shape acquisition section 51. Further, the height difference calculation section 52 calculates a difference (height difference H6 (see FIG. 6)) between a height H5 (see FIG. 6) of the travel plane S and the height H4 of the remote operation predicted travel region W. Note that the heights H4 and H5 are based on the installation position of the distance measurement sensor 6 and are each calculated based on the distance measured by the distance measurement sensor 6 and an inclination angle of the fourth straight line L4 relative to the travel plane S.

Meanwhile, the determination section 53, the warning section 54, and the travel control section 55 are the same as those of the aforementioned first embodiment. Further, the control processing of the control device 5 differs from that of the first embodiment in that the remote operation predicted travel region W is targeted, but the others are the same as the first embodiment. Thus, the overlapping description will be omitted.

When the work machine 1 is remotely operated, the operator performs operations based on, for example, an image or the like of a camera (not shown) mounted on the work machine 1, at a remote location from the work machine 1. When the camera image and an operation command from the remote operation device 11 are wirelessly communicated, communication delay occurs. Therefore, for example, when the operator instructs the work machine 1 to travel, using the remote operation device 11, there are some cases in which the operator is late in noticing a step or the like, due to poor visibility of the operator. Further, even when the operator immediately instructs the traveling stop via the remote operation device 11, the brake distance of the work machine 1 is greater than in a case where the operator is actually on board the work machine 1, due to the delay in wireless communication. As a result, the work machine 1 cannot stop traveling in time, and the crawler belts 21 could fall into the step or the work machine 1 falls from the step.

Thus, in the present embodiment, considering an increase in the brake distance, the remote operation predicted travel point P2 is set farther than the predicted travel point P1 and the distance measurement sensor 6 is disposed above the third straight line L3 passing the remote operation predicted travel point P2 and having the same angle as the maximum climbing angle θ relative to the travel plane S, so that the remote operation predicted travel region W is farther relative to the work machine 1. As a result, the detection of a step via the distance measurement sensor 6 can be expedited for the increase in the brake distance due to the remote operation. This can prevent the crawler belts 21 from falling into the step or the work machine 1 from falling from the step, thereby enabling to maintain the stability of the vehicle body and to suppress lowering of the productivity due to the unstable vehicle body.

In the aforementioned embodiment, the example in which only one distance measurement sensor 6 is installed on the upper turning body 3 of the work machine 1 (more specifically, the example in which the distance measurement sensor 6 is installed on the front side of the upper turning body 3) has been described, but the distance measurement sensor of the present invention may be a plurality of distance measurement sensors. For example, as shown in FIG. 7 and FIG. 8, the distance measurement sensors may also be installed on the rear side of the upper turning body 3 and on the lateral side of the upper turning body 3.

Figure 7:
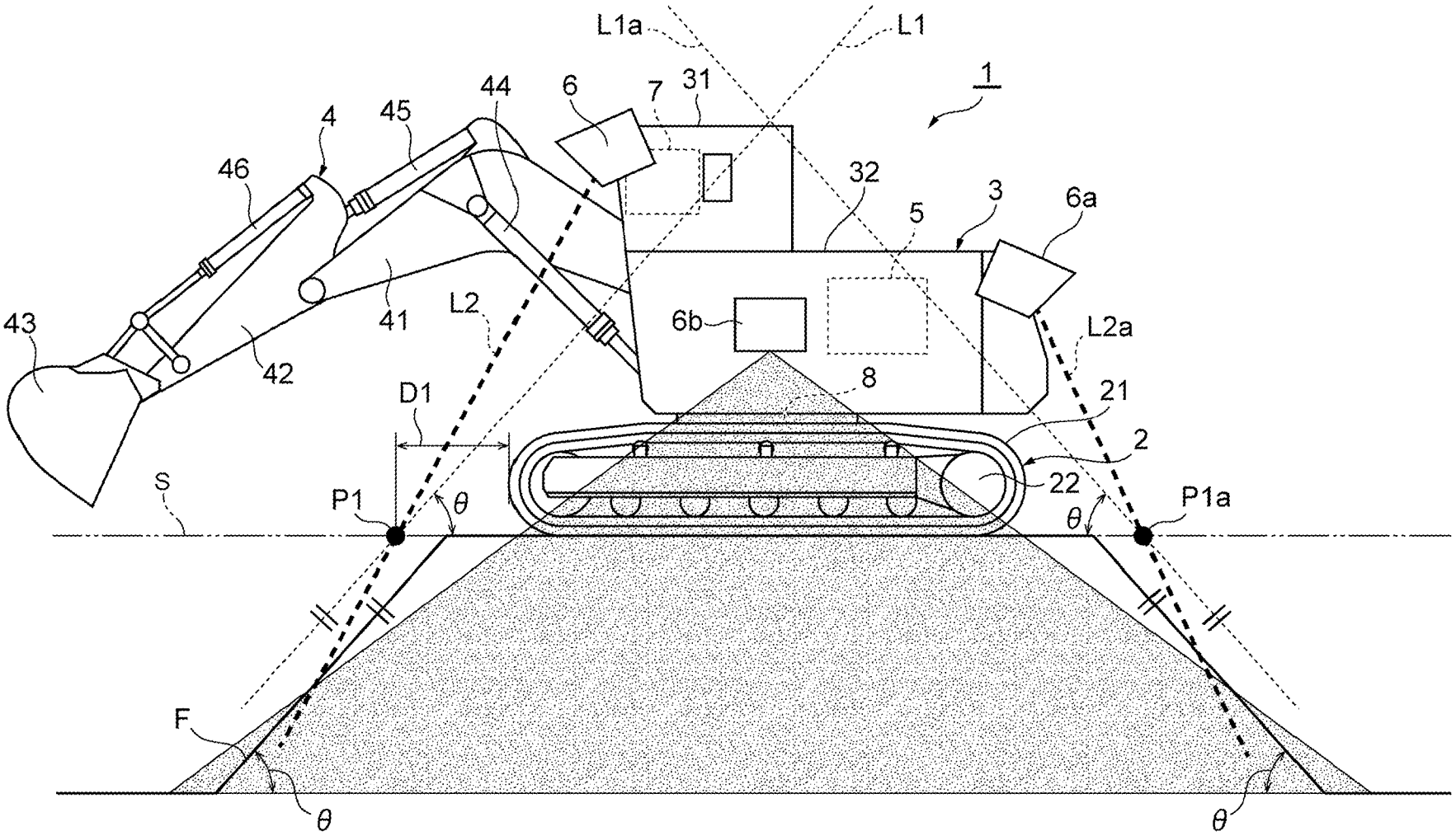
FIG. 7 is a side view showing the work machine further including a rear side distance measurement sensor, a left side distance measurement sensor, and a right side distance measurement sensor.
Figure 8:
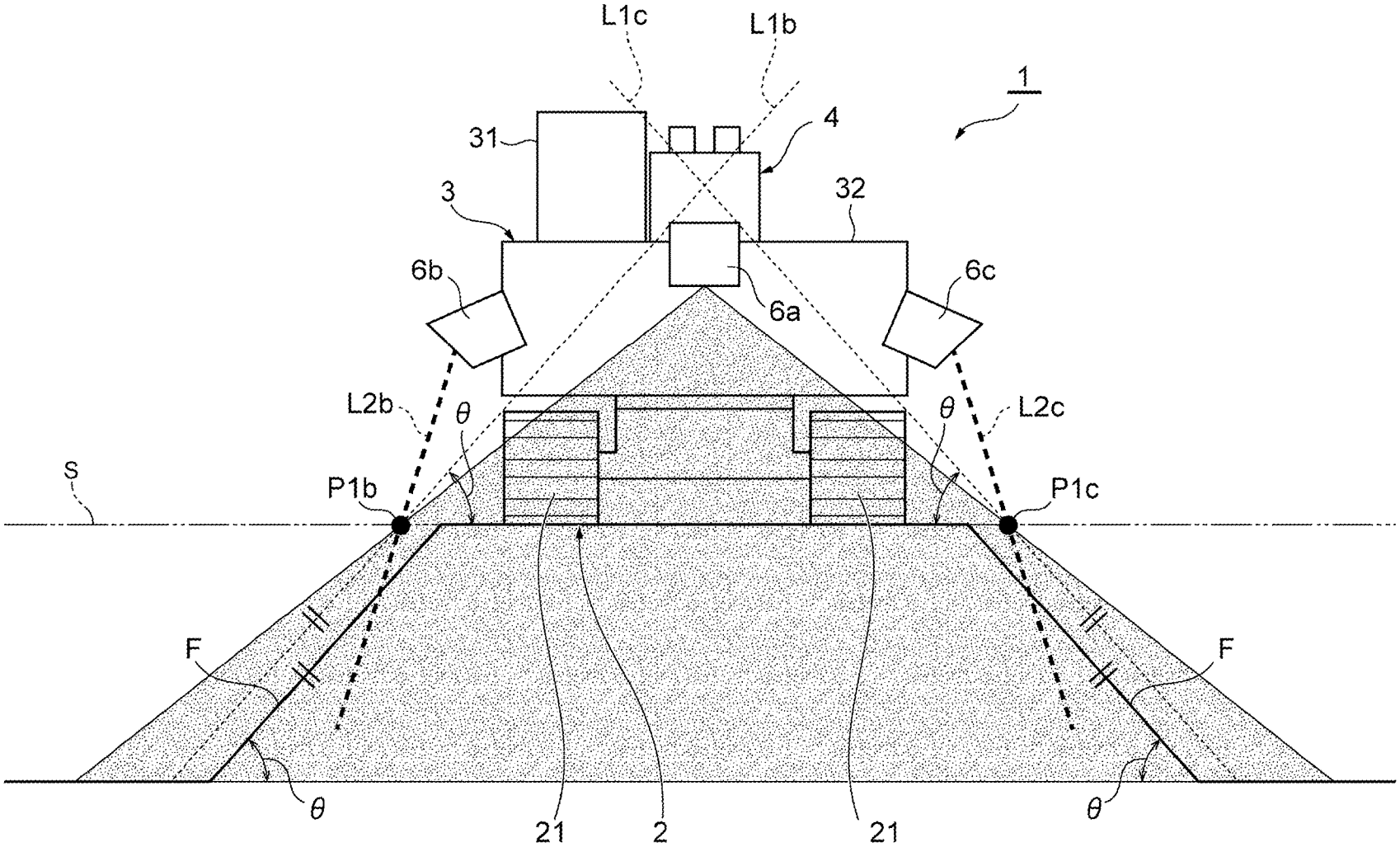
FIG. 8 is a back side view showing the work machine further including the rear side distance measurement sensor, the left side distance measurement sensor, and the right side distance measurement sensor.

As shown in FIG. 7 and FIG. 8, the work machine 1 further includes a rear side distance measurement sensor 6*a*, a left side distance measurement sensor 6*b*, and a right side distance measurement sensor 6*c*, in addition to the aforementioned distance measurement sensor 6. The rear side distance measurement sensor 6*a* is installed on the rear side of the upper turning body 3. The left side distance measurement sensor 6*b* and the right side distance measurement sensor 6*c* are installed on the left side and the right side of the upper turning body 3, respectively.

Further, the installation positions and the measurement positions of the rear side distance measurement sensor 6*a*, the left side distance measurement sensor 6*b*, and the right side distance measurement sensor 6*c* are specified based on the predicted travel point and the maximum climbing angle, as with the distance measurement sensor 6.

As shown in FIG. 7, for example, when on the travel plane S, a straight line passing a rear side predicted travel point P1*a* distanced by a given distance from the crawler belts 21 and having the same angle as the maximum climbing angle θ relative to the travel plane S is assumed to be a first straight line L1*a*, and a straight line connecting the installation position of the rear side distance measurement sensor 6*a* and the rear side predicted travel point P1*a* is assumed to be a second straight line L2*a*, the rear side distance measurement sensor 6*a* is installed on the upper turning body 3 so as to be positioned above the first straight line L1*a* and measures a distance from the installation position to the ground surface on the second straight line L2*a*. As with the predicted travel point P1 of the first embodiment, the position of the rear side predicted travel point P1*a* may be specified based on the brake distance and may be specified to be farther as compared to the brake distance.

Further, as shown in FIG. 8, when on the travel plane S, a straight line passing a left side predicted travel point P1*b* distanced by a given distance from the crawler belts 21 and having the same angle as the maximum climbing angle θ relative to the travel plane S is assumed to be a first straight line L1*b*, and a straight line connecting the installation position of the left side distance measurement sensor 6*b* and the left side predicted travel point P1*b* is assumed to be a second straight line L2*b*, the left side distance measurement sensor 6*b* is installed on the upper turning body 3 so as to be positioned above the first straight line Lib and measures a distance from the installation position to the ground surface on the second straight line L2*b*. As with the predicted travel point P1 of the first embodiment, the position of the left side predicted travel point P1*b* may be specified based on the brake distance and may be specified to be farther as compared to the brake distance.

Further, when on the travel plane S, a straight line passing a right side predicted travel point P1*c* distanced by a given distance from the crawler belts 21 and having the same angle as the maximum climbing angle θ relative to the travel plane S is assumed to be a first straight line L1*c*, and a straight line connecting the installation position of the right side distance measurement sensor 6*c* and the right side predicted travel point P1*c* is assumed to be a second straight line L2*c*, the right side distance measurement sensor 6*c* is installed on the upper turning body 3 so as to be positioned above the first straight line L1*c* and measures a distance from the installation position to the ground surface on the second straight line L2*c*. As with the predicted travel point P1 of the first embodiment, the position of the right side predicted travel point Plc may be specified based on the brake distance and may be specified to be farther as compared to the brake distance.

Furthermore, the distance measurement sensor 6, the rear side distance measurement sensor 6*a*, the left side distance measurement sensor 6*b*, and the right side distance measurement sensor 6*c* are 2D LIDAR, for example, and as shown in FIG. 7 or FIG. 8, the measurement region is a two-dimensional plane in the lateral direction having a given angle. Note that the triangles shown in FIG. 7 and FIG. 8 are schematic illustrations of the measurement ranges of the left side distance measurement sensor 6*b* and the rear side distance measurement sensor 6*a*.

In this manner, with the rear side distance measurement sensor 6*a*, the left side distance measurement sensor 6*b*, and the right side distance measurement sensor 6*c* further provided, the steps present on the rear, left, and right sides of the crawler belts 21 can be detected without turning the upper turning body 3, and thus, the stability of the vehicle body can be surely maintained.

Note that the examples shown in FIG. 7 and FIG. 8 are also applied to the aforementioned second embodiment, and the overlapping description are omitted.

The embodiments of the present invention have been described above in detail, but the present invention is not limited to the aforementioned embodiments, and various design changes are available within the scope without departing from the spirit of the present invention described in the scope of claims.

REFERENCE SIGNS LIST

1 work machine
2 lower traveling body
3 upper turning body
4 front device
5 control device
6 distance measurement sensor
6*a* rear side distance measurement sensor
6*b* left side distance measurement sensor
6*c* right side distance measurement sensor
7 notification device
8 turning angle sensor
9 display section
11 remote operation device
12 wireless transmitter
13 wireless receiver
21 crawler belt
F slope
L1, L1*a*, L1*b*, L1*c* first straight line
L2, L2*a*, L2*b*, L2*c* second straight line
L3 third straight line
L4 fourth straight line
P1 predicted travel point
P1*a* rear side predicted travel point
P1*b* left side predicted travel point
P1*c* right side predicted travel point
P2 remote operation predicted travel point
S travel plane
T, T1, T2, T3, T4 predicted travel region
W remote operation predicted travel region
θ maximum climbing angle

The invention claimed is:

1. A work machine provided with a lower traveling body having crawler belts and an upper turning body provided in the lower traveling body so as to freely turn, the work machine comprising:

at least one distance measurement sensor installed on the upper turning body;

a turning angle sensor that detects a relative turning angle between the upper turning body and the lower traveling body;

a notification device that notifies an operator of the work machine of information; and a control device that controls the lower traveling body and the notification device, wherein when on a travel plane of the crawler belts, a straight line passing a predicted travel point distanced by a given distance from the crawler belts and having an angle corresponding to a maximum climbing angle of the work machine directed downward relative to the travel plane of the crawler belts is assumed to be a first straight line, and a straight line connecting an installation position of the distance measurement sensor and the predicted travel point is assumed to be a second straight line, the installation position of the distance measurement sensor being provided at a location above the first straight line of the upper turning body and the distance measurement sensor measures a distance from the installation position to a ground surface below the travel plane along the second straight line, and wherein when a region on the ground surface measured by the distance measurement sensor is assumed to be a predicted travel region, the control device calculates a height difference between the travel plane of the crawler belts and the predicted travel region based on a measurement result of the distance measurement sensor and a detection result of the turning angle sensor, and determines whether the height difference is equal to or greater than a preset threshold, and actuates the notification device when it is determined that the height difference is equal to or greater than the threshold.

2. The work machine according to claim 1, wherein the control device controls the lower traveling body to stop travelling when it is determined that the height difference is equal to or greater than the threshold.

3. The work machine according to claim 1, wherein the control device controls the lower traveling body to travel in a direction in which the height difference is smaller than the threshold when it is determined that the height difference is equal to or greater than the threshold.

4. The work machine according to claim 1, wherein the predicted travel region is a dotted region in a front-rear direction of the lower traveling body.

5. The work machine according to claim 1, wherein the predicted travel region is a linear region along a left-right direction of the lower traveling body.

6. The work machine according to claim 1, wherein the predicted travel region is a ring-shaped region surrounding the lower traveling body.

7. The work machine according to claim 1, wherein the predicted travel region is a linear region along a front-rear direction of the lower traveling body.

8. The work machine according to claim 1, wherein the notification device comprises a display section that displays a position of the work machine and a position of the height difference.

9. The work machine according to claim 1, further comprising a remote operation device that wirelessly transmits an operation command to the control device, wherein when on the travel plane of the crawler belts, a straight line passing a remote operation predicted travel point that is farther than the predicted travel point relative to the work machine and having an angle corresponding to the maximum climbing angle of the work machine directed downward relative to the travel plane is assumed to be a third straight line, and a straight line connecting the installation position of the distance measurement sensor and the remote operation predicted travel point is assumed to be a fourth straight line, the installation position of the distance measurement sensor being provided at a location further above the third straight line of the upper turning body and the distance measurement sensor measures a distance from the installation position to the ground surface below the travel plane along the fourth straight line below, and wherein when a region on the ground surface measured by the distance measurement sensor is assumed to be a remote operation predicted travel region, the control device calculates a height difference between the travel plane of the crawler belts and the remote operation predicted travel region based on a measurement result of the distance measurement sensor and a detection result of the turning angle sensor, and determines whether the height difference is equal to or greater than the threshold, and actuates the notification device when it is determined that the height difference is equal to or greater than the threshold.

* * * * *